US009677796B2

(12) United States Patent
Schaeffer et al.

(10) Patent No.: US 9,677,796 B2
(45) Date of Patent: Jun. 13, 2017

(54) MODULAR REFRIGERATION ASSEMBLY

(71) Applicant: Hussmann Corporation, Bridgeton, MO (US)

(72) Inventors: Wayne G. Schaeffer, Wildwood, MO (US); Jeffrey J. Marchand, Ontario (CA); Carlton Hardie, Buford, GA (US)

(73) Assignee: Hussmann Corporation, Bridgeton, MO (US)

( * ) Notice: Subject to any disclaimer, the term of this patent is extended or adjusted under 35 U.S.C. 154(b) by 314 days.

(21) Appl. No.: 14/200,278

(22) Filed: Mar. 7, 2014

(65) Prior Publication Data

US 2015/0253048 A1 Sep. 10, 2015

(51) Int. Cl.
*F25B 41/00* (2006.01)
*F25B 1/00* (2006.01)

(52) U.S. Cl.
CPC ..... *F25B 41/003* (2013.01); *F25B 1/005* (2013.01)

(58) Field of Classification Search
CPC ..... F25B 41/003; F25B 1/005
See application file for complete search history.

(56) References Cited

U.S. PATENT DOCUMENTS 2,387,356 A * 10/1945 Robison ..... F25B 39/02 30/34.1
2,576,208 A 11/1951 Benson
2,585,360 A * 2/1952 Williams ..... F25D 3/06 211/126.1
4,114,065 A 9/1978 Horvay
4,162,571 A 7/1979 Horvay
5,054,296 A 10/1991 Sotani et al.
2013/0299529 A1* 11/2013 Minning ..... B61D 45/00 224/29.5

FOREIGN PATENT DOCUMENTS

JP 07045981 A * 2/1995
JP 2012112627 A * 6/2012

OTHER PUBLICATIONS

"Hussmann parallel rack compressor systems," known and accessible to the public at least prior to Mar. 7, 2013, as illustrated and described from the Internet at http://www.hussmann.com/en/Products/Refrigeration-Systems/parallel-racks/Pages/Parallel-Rack-Compressor.aspx (including product brochure) and from the accompanying statement of relevance (6 pages).

* cited by examiner

*Primary Examiner* — Emmanuel Duke
(74) *Attorney, Agent, or Firm* — Michael Best & Friedrich LLP

(57) ABSTRACT

A subassembly of a refrigeration system includes a frame having a plurality of support members and one or more cross members, each cross member extending between two of the support members. A heat exchanger is operable to condense refrigerant. A compressor is supported by the frame and operable to provide refrigerant to the heat exchanger. A portion of the frame is configured to receive and contain refrigerant condensed by the heat exchanger.

18 Claims, 12 Drawing Sheets

MODULAR REFRIGERATION ASSEMBLY

BACKGROUND

The present invention relates to a modular refrigeration assembly having a frame subassembly configured to contain refrigerant.

SUMMARY

In one construction, a subassembly of a refrigeration system includes a frame having a plurality of support members and one or more cross members, each cross member extending between two of the support members. A heat exchanger is operable to condense refrigerant. A compressor is supported by the frame and operable to provide refrigerant to the heat exchanger. A portion of the frame is configured to receive and contain refrigerant condensed by the heat exchanger.

In one construction, a frame subassembly for a refrigeration assembly includes a frame and a mounting surface coupled to the frame and configured to support at least one of a compressor and a heat exchanger of the refrigeration assembly. The frame is further configured to receive and contain refrigerant condensed by the heat exchanger.

In one construction, a refrigeration system includes a compressor operable to provide a flow of refrigerant to a heat exchanger and a receiver operable to store refrigerant condensed by the heat exchanger. At least one of the compressor and the heat exchanger is supported at least in part by the receiver.

In one construction, a method for operating a refrigeration circuit includes operating a compressor of the refrigeration circuit to compress a refrigerant, discharging the compressed refrigerant to a heat exchanger, and condensing at least a portion of the compressed refrigerant within the heat exchanger. The method also includes receiving the condensed refrigerant within a structure configured to at least partially support at least one of the compressor and the heat exchanger.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
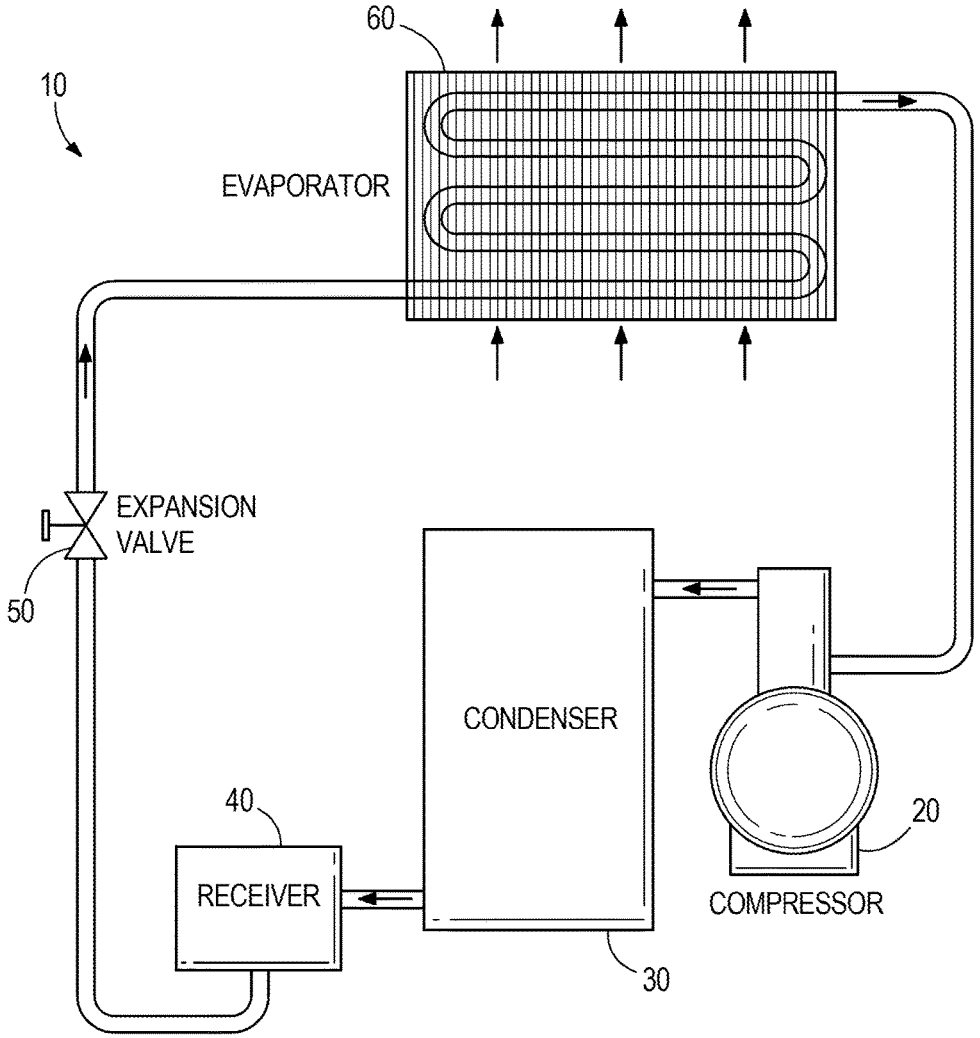
FIG. 1 is a schematic of a refrigeration system.

FIG. 1 is a simplified diagram of the basic components of a typical one-stage vapor-compression refrigeration system 10. In this cycle, a circulating refrigerant enters the compressor 20 as a vapor. In the compressor 20 the vapor is compressed and exits the compressor superheated. An oil separator (not shown) removes most of the oil entrained in the superheated vapor, which then travels through the condenser 30. The condenser 30 first cools and removes the superheat and then condenses the vapor into a liquid by removing additional heat at constant pressure and temperature. A receiver 40 receives the condensed refrigerant, which is then directed through an expansion valve 50 where its pressure abruptly decreases, causing flash evaporation of a portion of the liquid. This results in a mixture of liquid and vapor at a lower temperature and pressure. The cold liquid-vapor mixture travels through the coils of the evaporator 60 and is vaporized by cooling warm air returning from the refrigerated space. The refrigerant, now in vapor form, returns to the compressor inlet to complete the thermodynamic cycle. As one of ordinary skill in the art will appreciate, the refrigeration circuit 10 can include other components depending on design parameters and the conditioning needs for which the refrigeration circuit 10 is being used. The refrigeration assembly to be described herein is not limited in its application to a particular purpose, but may be used in any application in which heat is exchanged between a thermal medium and a surrounding environment.

Figure 2:
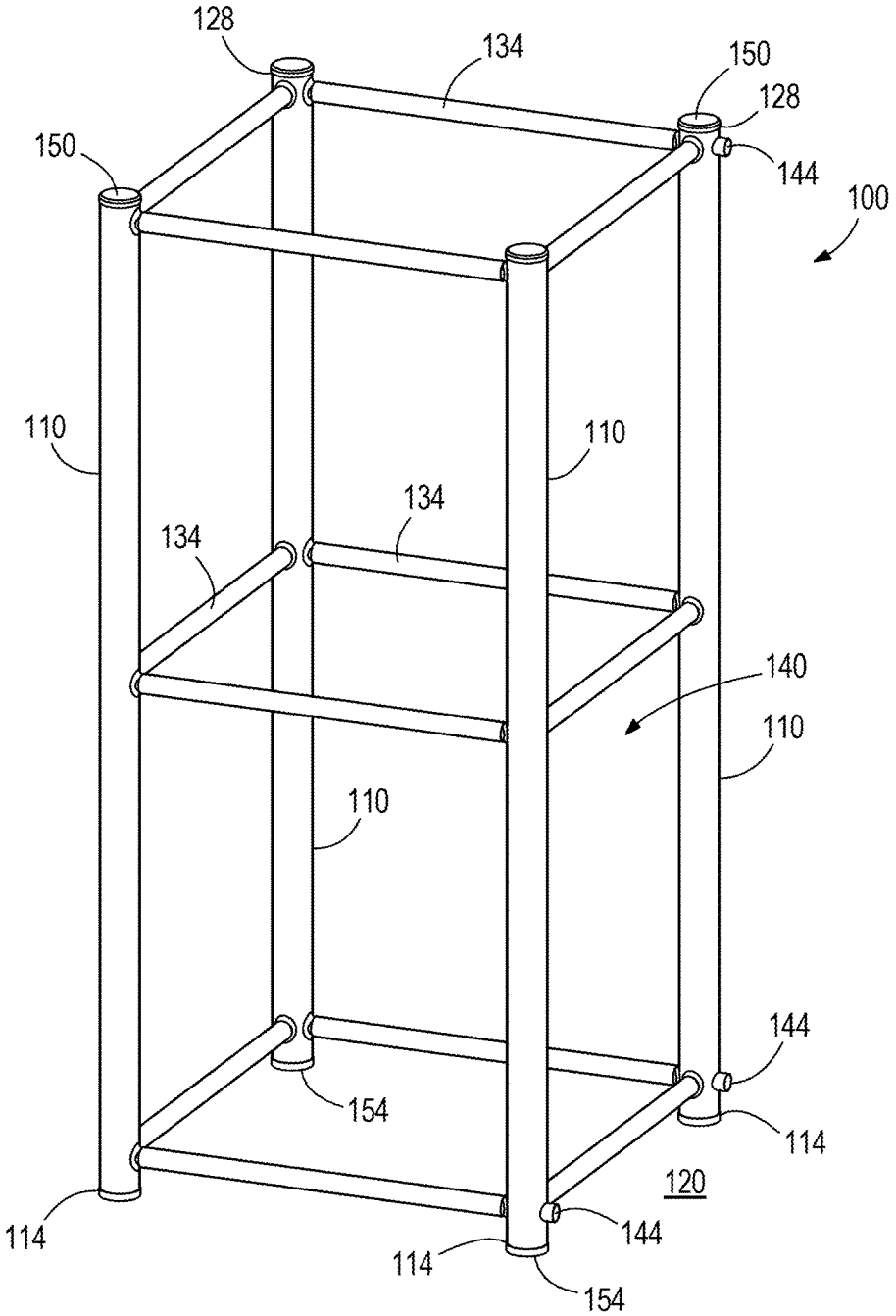
FIG. 2 is a perspective view of a frame subassembly of a refrigeration assembly.
Figure 3:
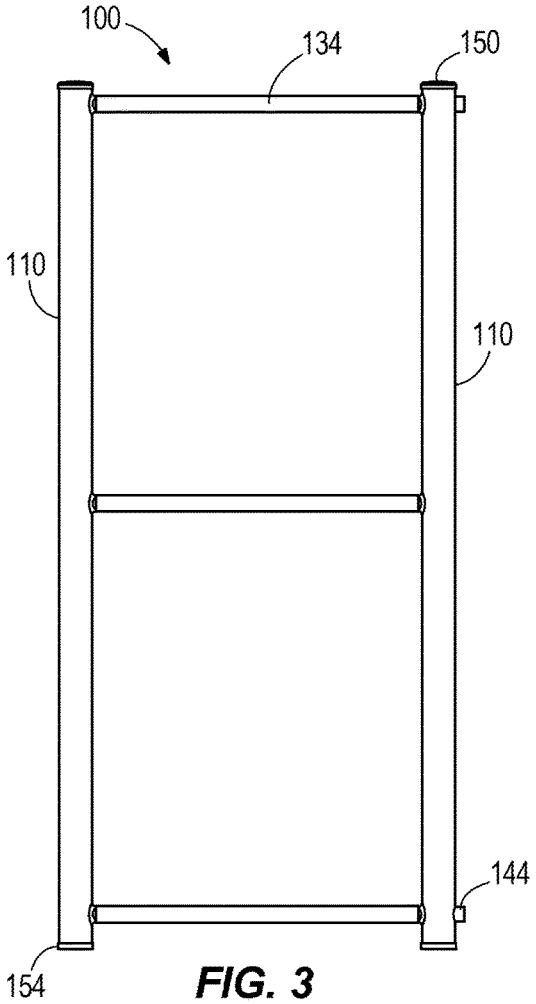
FIG. 3 is a first side view of the frame subassembly of FIG. 2.
Figure 4:
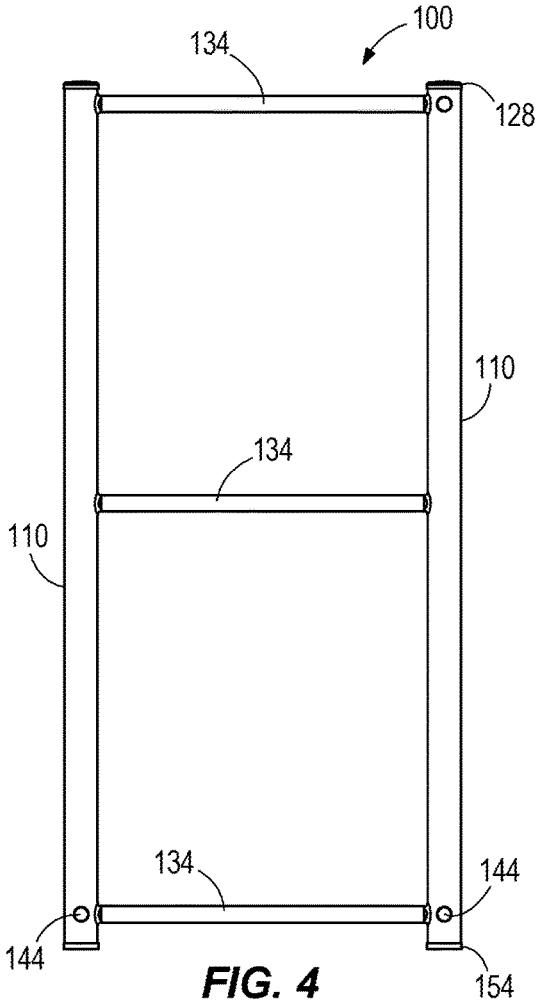
FIG. 4 is a second side view of the frame subassembly of FIG. 2.
Figure 5:
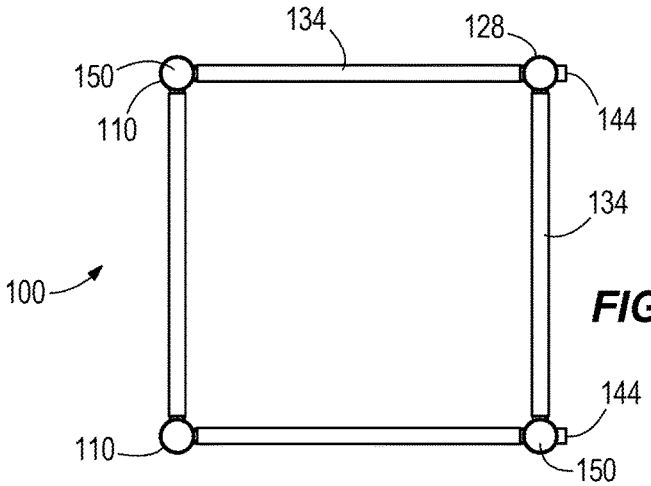
FIG. 5 is a top view of the frame subassembly of FIG. 2.

With reference to FIGS. 2-5, a frame subassembly 100 for the refrigeration assembly includes a plurality of vertically oriented supporting members or legs 110. The legs 110 are of a hollow construction and may be from approximately 3" to 6" in diameter. Each leg 110 includes a first end 114 positioned on a support surface 120, such as the ground, and a second end 128. A plurality of horizontal supporting members or cross members 134, each hollow and from approximately 1" to 3" in diameter, provides bracing for the frame subassembly 100. Referring to FIG. 2, four cross members 134 positioned at lower, middle, and upper parts of the subassembly 100 form sub-frames that increase the structural integrity of the subassembly 100 and that additionally support a platform, as will be seen. The legs 110 and cross members 134 are preferably constructed from steel, such as carbon steel or stainless steel, or from any other material suitable for the application.

The legs 110 are spaced from each other to provide a generally rectangular assembly region 140. Each leg 110 and cross member 134 of the subassembly 100 is in internal communication with every other connected leg 110 and cross member 134 such that an internal containment volume is formed having a total volume equal to the combined internal volume of each leg 110 and cross member 134. In an alternative embodiment, however, one or more of the legs 110 and/or cross members 134 may be isolated, i.e., not in internal communication with the remaining legs 110 and/or cross members 134 and the containment volume will be correspondingly lower. As an example, plugs, discs, or other barriers (not shown) can be welded or otherwise secured at the interface between select cross members 134 and associated legs 110 to facilitate such separation.

One or more of the legs 110 includes a port 144 in communication with and providing access to the containment volume, with at least one port 144 positioned near a first end 114 of one of the legs 110 and one port 144 positioned near a second end 128 of one of the legs 110, as will be further explained below. Each leg 110 includes a top cap 150 and a bottom cap 154, with the bottom caps 154 further configured as necessary for direct contact with the support surface 120.

Figure 6:
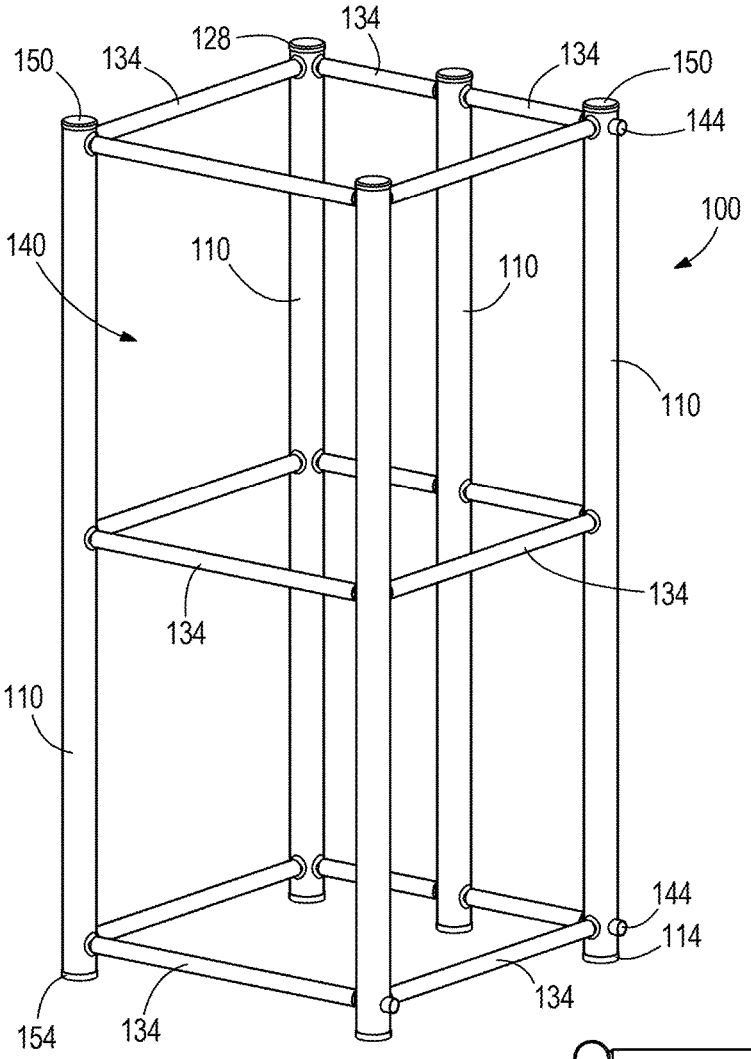
FIG. 6 is a perspective view of another frame subassembly of a refrigeration assembly.
Figure 7:
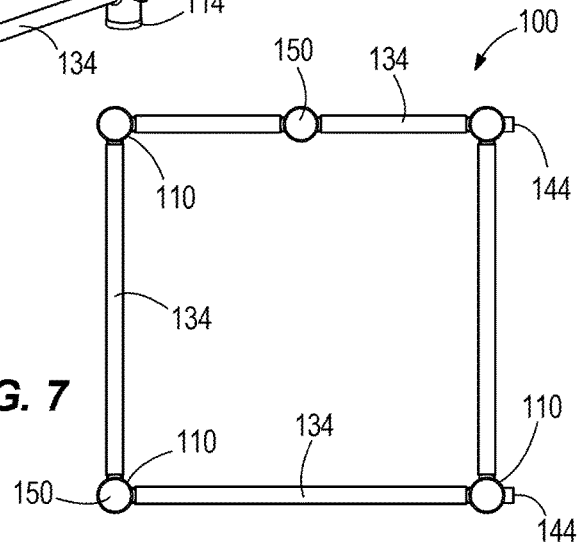
FIG. 7 is a top view of the frame subassembly of FIG. 6.

FIGS. 6 and 7 illustrate another frame subassembly 100. A fifth leg 110 is positioned between any two of the other legs 110, with shorter cross members 134 connecting the fifth leg 110 to the adjacent legs 110. The fifth leg 110 provides additional structural integrity to the subassembly 100 and consequently increases the size of the containment volume. The frame subassembly 100 of FIGS. 6-7 is in all other respects identical to the frame subassembly 100 of FIGS. 2-5.

Figure 8:
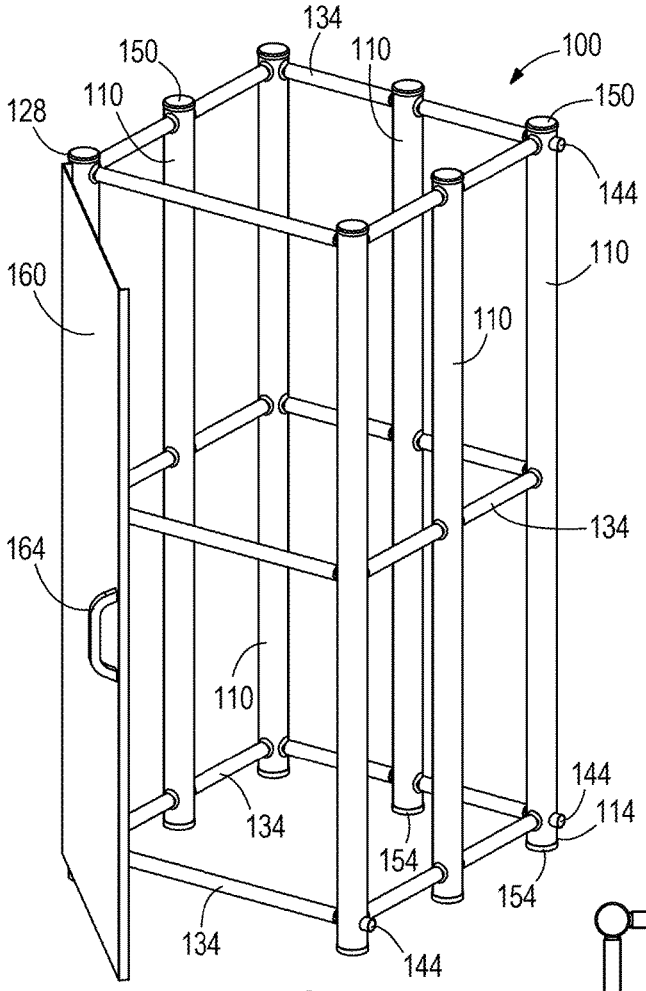
FIG. 8 is a perspective view of another frame subassembly of a refrigeration assembly.
Figure 9:
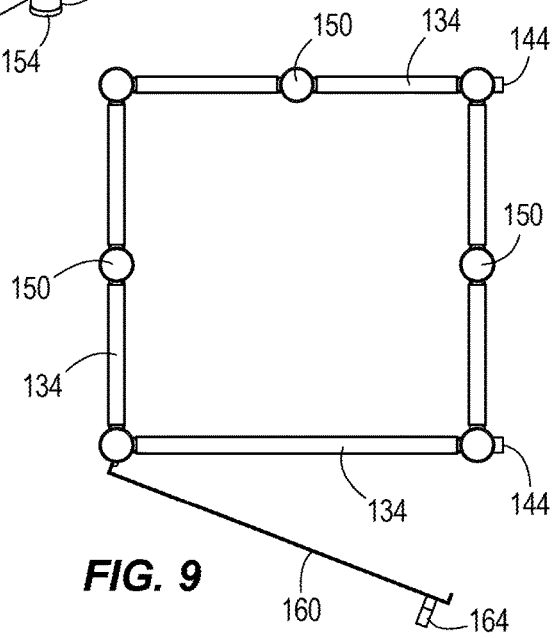
FIG. 9 is a top view of the frame subassembly of FIG. 8.

FIGS. 8 and 9 illustrate a frame subassembly 100 having an additional leg 110 on three of the four sides and an access door 160 on the fourth side. The access door 160 is hinged or otherwise pivotally coupled to one of the legs 110 and includes a handle 164 for manual access.

Figure 10:
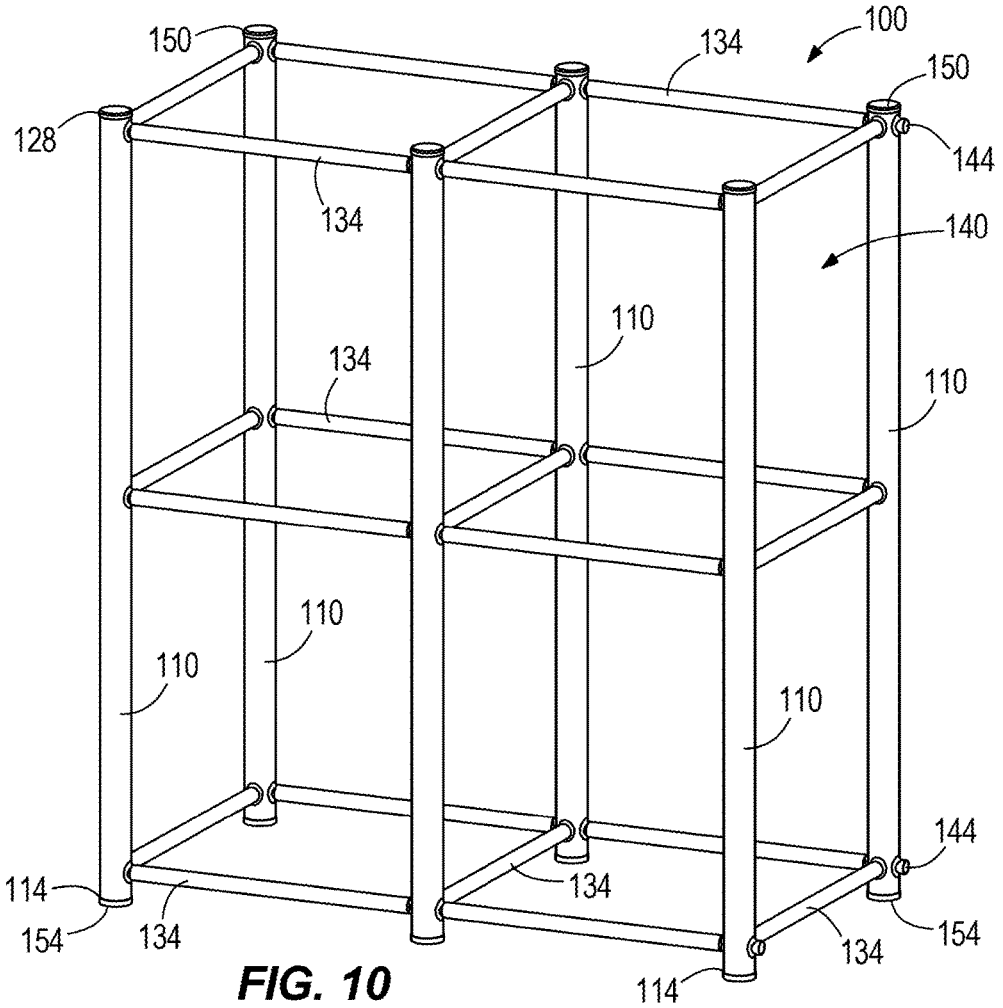
FIG. 10 is a perspective view of another frame subassembly of a refrigeration assembly.
Figure 11:
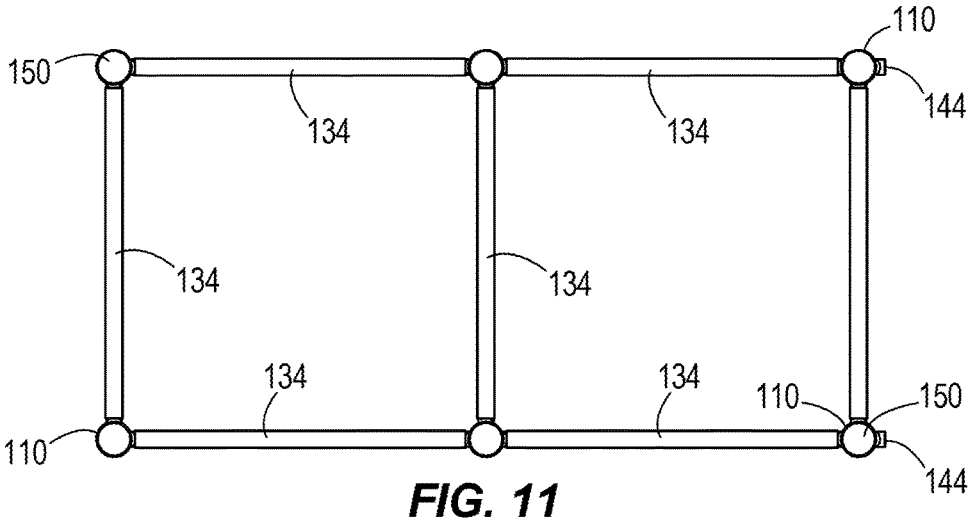
FIG. 11 is a top view of the frame subassembly of FIG. 10
Figure 12:
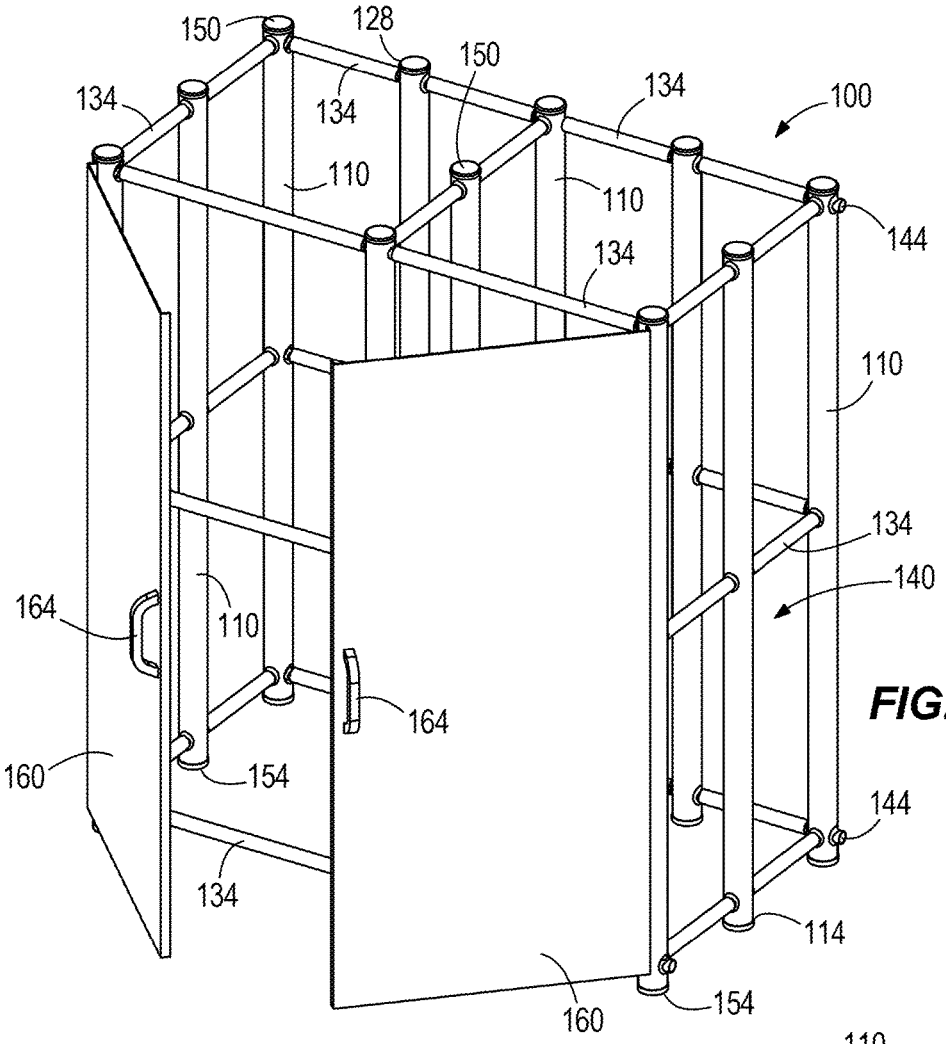
FIG. 12 is a perspective view of another frame subassembly of a refrigeration assembly.
Figure 13:
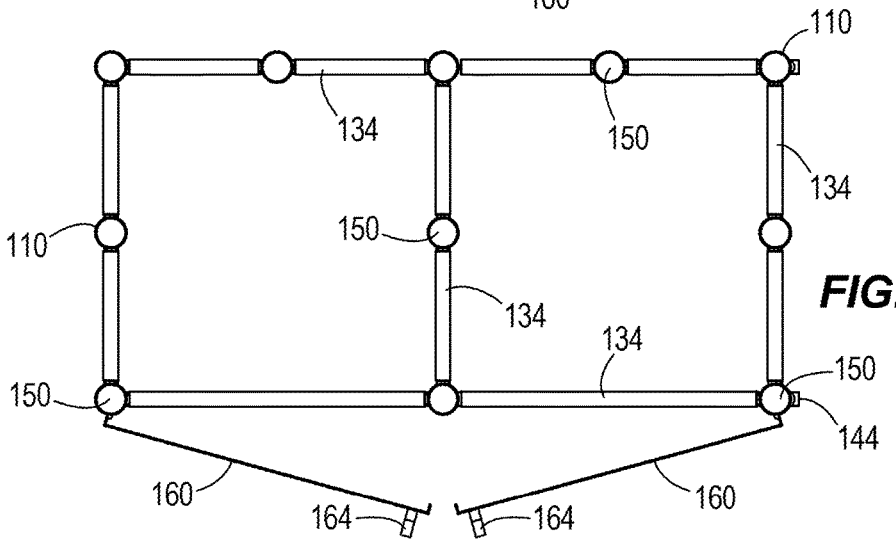
FIG. 13 is a top view of the frame subassembly of FIG. 12

The embodiment of FIGS. 10 and 11 demonstrates the modular construction of another frame subassembly 100. Additional legs 110 and cross members 134 can be adjacently secured to each other to increase the size of the subassembly 100 and the assembly region 140. The relationship between each cross member 134 and leg 110 is as previously described. In some applications, the frame subassembly 100 may be internally isolated to form separate containment volumes within the subassembly 100 or to otherwise modify the size of the working containment volume, using the aforementioned plugs, discs, or other barriers. Referring to FIGS. 12 and 13, first and second doors 160 can each be pivotally connected to an outside leg 110, opening outward to provide access to the assembly region 140.

Figure 14:
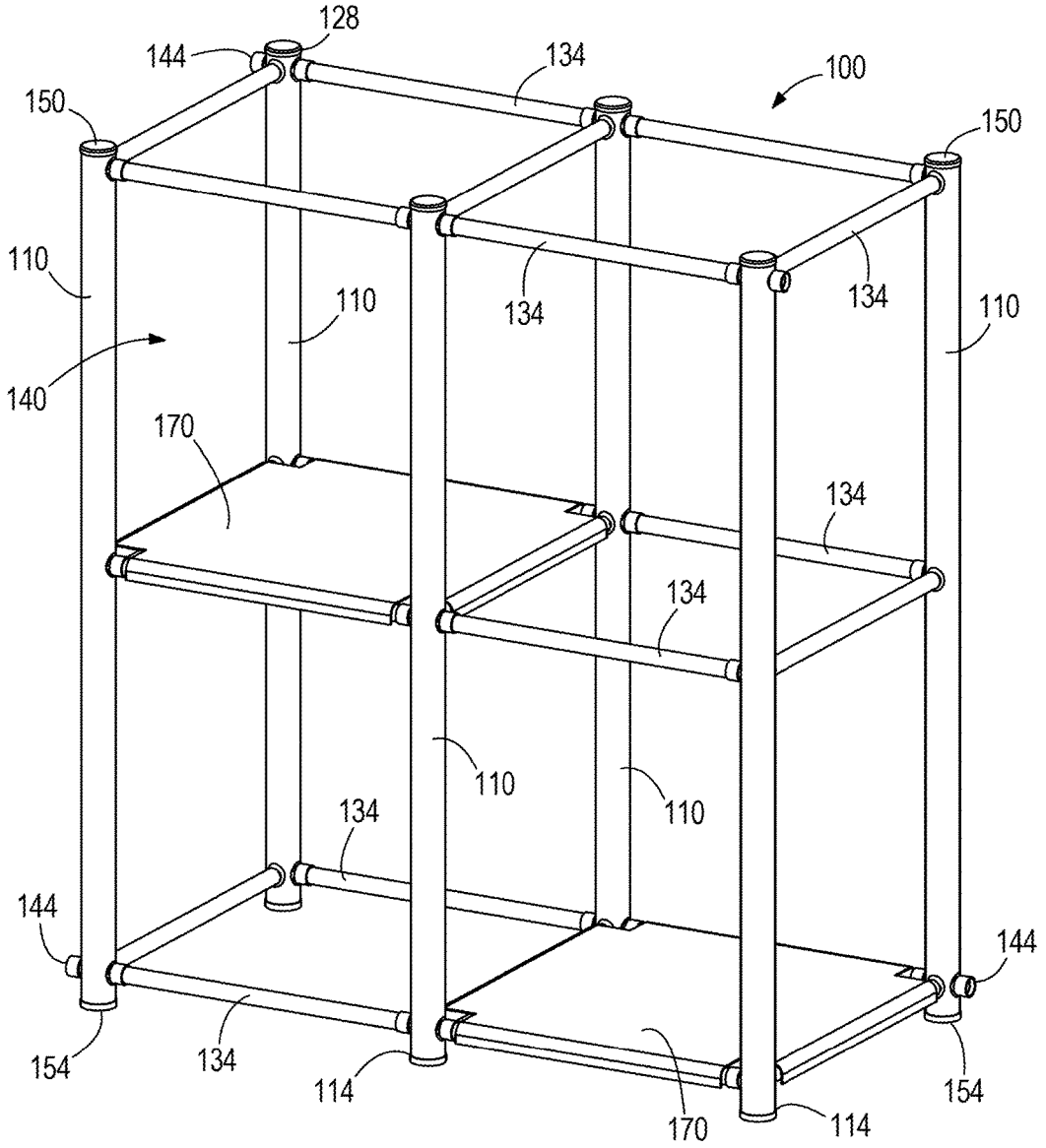
FIG. 14 is a perspective view of another frame subassembly of a refrigeration assembly.

FIG. 14 illustrates a frame subassembly 100 similar to the assembly of FIG. 10, but including a mounting surface or platform 170 positioned on a lower sub-frame of cross members 134 and a platform 170 positioned on a middle sub-frame of cross members 134. The platforms 170 can be placed upon the respective cross members 134 or secured thereto with conventional fasteners. The platforms 170 are of sufficient strength to support the weight of one or more refrigeration components of a refrigeration system, as will be further described below. Platforms 170 can be positioned on some or all of the available cross members 134 of the subassembly 100. As shown in FIG. 14, the ports 144 providing access to the containment volume can be oriented on any leg 110 depending on the requirements of a specific application.

Figure 15:
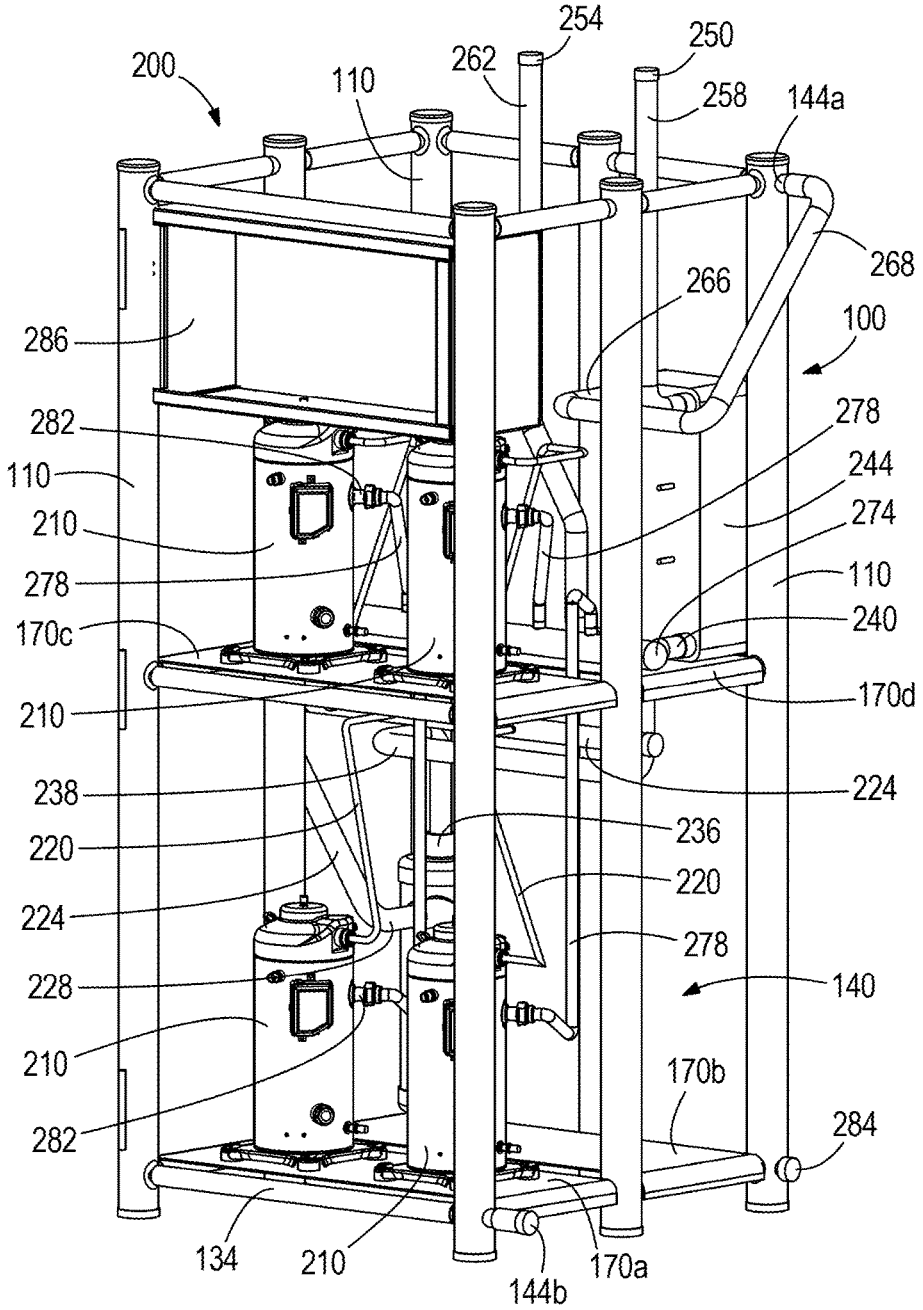
FIG. 15 is a front perspective view of a refrigeration assembly.
Figure 16:
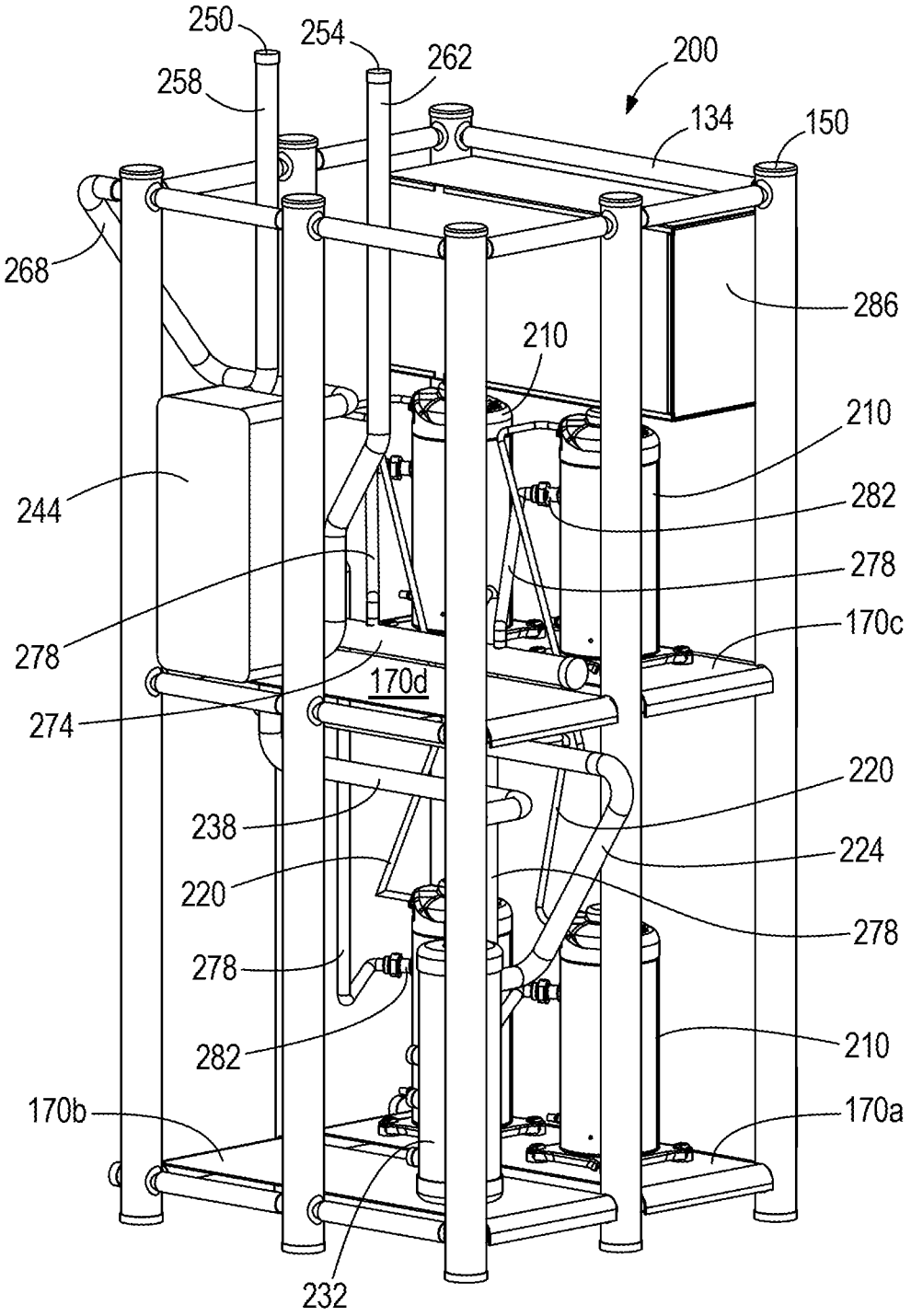
FIG. 16 is a rear perspective view of the refrigeration assembly of FIG. 15.
Figure 17:
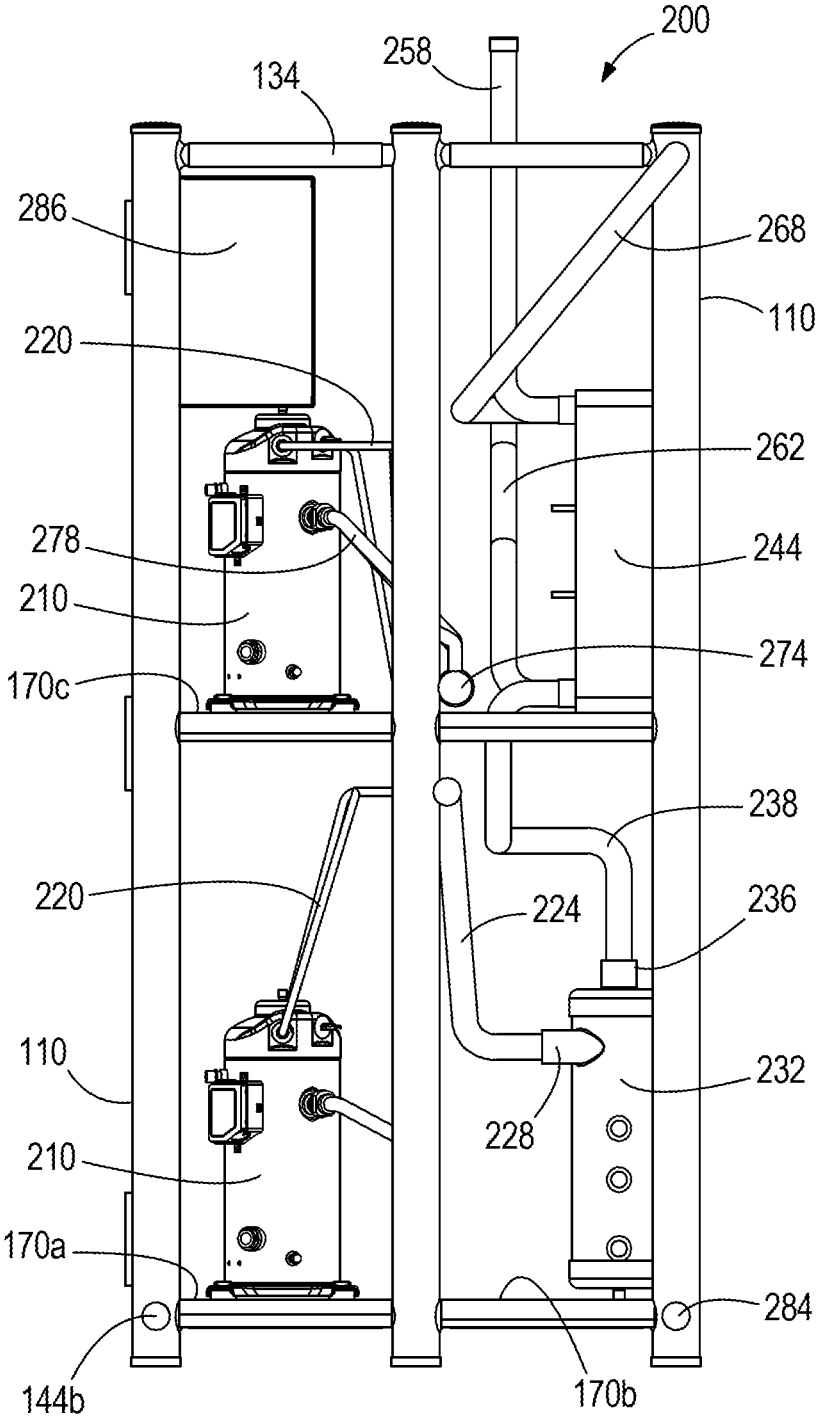
FIG. 17 is a side view of the refrigeration assembly of FIG. 15.
Figure 18:
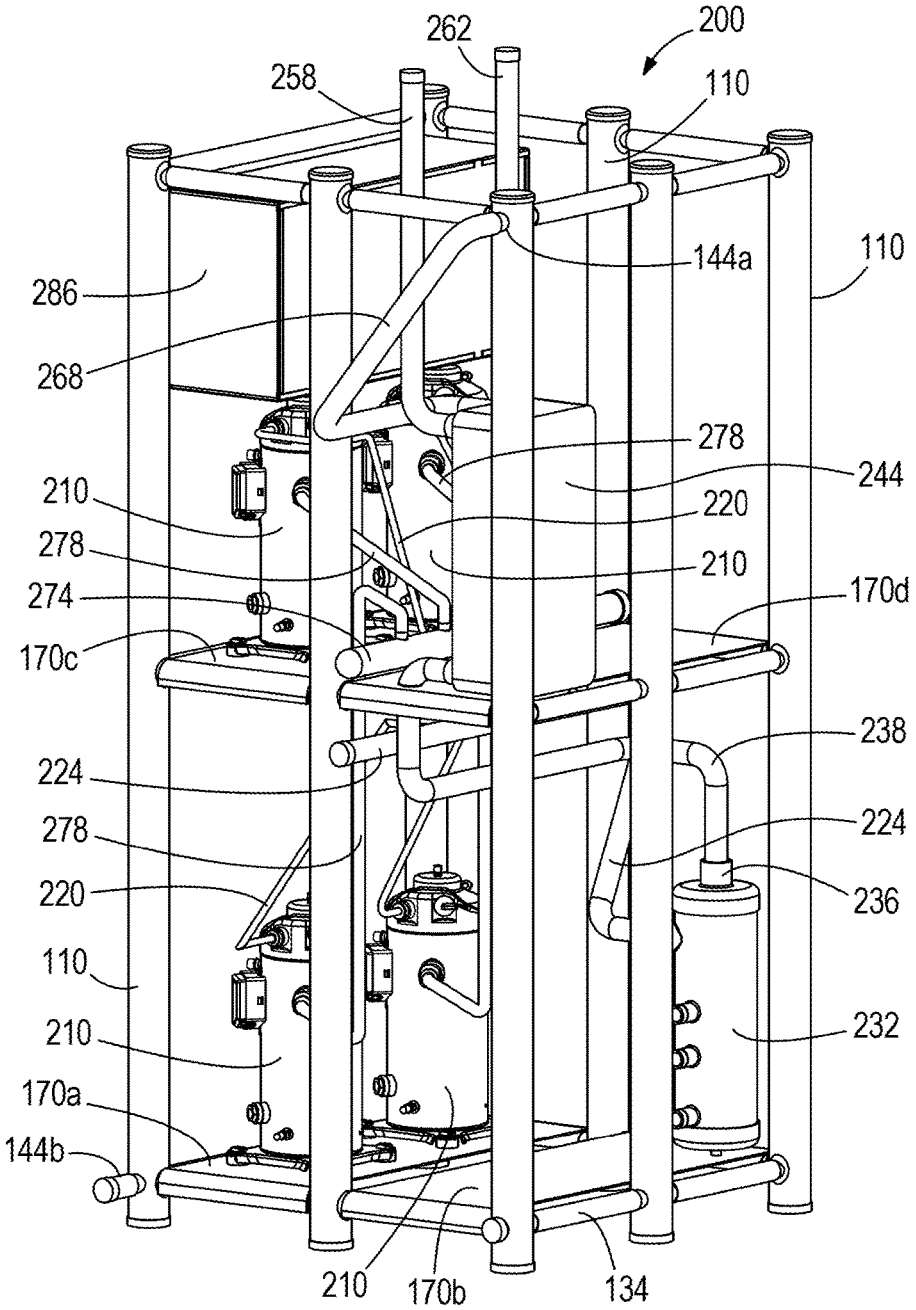
FIG. 18 is another rear perspective view of the refrigeration assembly of FIG. 15.

FIG. 15 shows a refrigeration assembly 200. The refrigeration assembly 200 includes a frame subassembly 100 similar to those previously described and shown in FIGS. 2-14. Specifically, the frame subassembly 100 illustrated is similar to that of FIG. 8 and includes four hollow legs 110 forming the "corners" of the assembly region 140. The legs 110 are interconnected with a plurality of hollow cross members 134. First and second platforms 170*a*, 170*b* extend between cross members (partially concealed by portions of the platforms 170*a*, 170*b*) that form two sub-frames at a lower portion of the subassembly 100. Third and fourth platforms 170*c*, 170*d* extend between cross members (partially concealed by portions of the platforms 170*c*, 170*d*) forming two additional sub-frames at a middle portion of the subassembly 100.

The refrigeration assembly 200 includes one or more components of a refrigeration system or circuit. As shown in FIGS. 15-18, two compressors 210 are positioned on the first platform 170*a* and two compressors are positioned on the third platform 170*c*. The compressors 210 shown are scroll compressors, but other types, such as reciprocating compressors, may be used in accordance with the application. The compressors 210 are piped in a parallel arrangement, although the refrigeration assembly 200 may be operable with three or fewer or five or more compressors. Individual discharge lines 220 lead from each compressor 210 to a discharge header 224. The discharge header 224 is connected to the inlet 228 of an oil separator 232 located on the second platform 170*b*, the outlet 236 of which leads via a pipe 238 to a refrigerant inlet 240 of a condenser 244 on the fourth platform 170*d*. The condenser 244 includes inlet and outlet connections 250, 254 for an external cooling medium, for example, water, which is in fluid communication with the condenser 244 through inlet and outlet pipes 258, 262. In some embodiments, the condenser 244 is remotely located and could be, for example, an externally positioned air-cooled condenser.

The refrigerant outlet 266 of the condenser 244 is connected by a pipe 268 to an upper port 144*a* of the subassembly 100. The subassembly 100, as previously described, is constructed to form a containment volume, which serves as the condensed refrigerant receiver (see the receiver 40 of FIG. 1) in the present refrigeration assembly 200. A port 144*b* on the lower part of the subassembly 100 leads to an expansion valve and evaporator (not shown) both external to the refrigeration assembly 200 and positioned at a separate location for cooling a source of supply air. For example, the evaporator may be positioned inside a merchandiser to keep food products cold. In modular refrigeration units, e.g., those refrigeration assemblies 200 with a subassembly 100 such as illustrated in FIGS. 10 and 11 that can support or hold the components of more than one refrigeration circuit, more than one upper port 144*a* and more than one lower port 144*b* may be used and the overall subassembly 100 internally separated to form two or more receivers to match the number of refrigeration circuits. Any ports 144 not used in a particular application are capped with a cap 284 or otherwise sealed. A suction header 274 for receiving vaporized refrigerant from the system evaporator includes a plurality of pipes 278 leading to the suction inlets 282 of each respective compressor 210.

An electrical enclosure 286 can be located on the frame assembly 100 for the containment of electrical and electronic equipment necessary for the operation of the refrigeration assembly 200, which may be controlled locally or remotely.

In operation, a refrigerant enters the compressors 210 through the suction lines 278 extending from the suction header 274. The compressors 210 compress the refrigerant to a superheated vapor and discharge the refrigerant through the respective discharge lines 220 to the discharge header 224. The refrigerant flows through the discharge header 224 to the oil separator 232 where entrained oil is removed from the refrigerant stream. From the oil separator 232, the superheated refrigerant is directed through the pipe 238 to the condenser 244. The flow of cooling water via the pipes 258, 262 condenses the vapor within the condenser 244 into a liquid state. From the condenser 244, the liquid refrigerant flows through the pipe 268 and enters the subassembly 100 through the inlet port 144*a*. The internal containment volume defined by the subassembly 100 functions as a receiver in a refrigeration circuit to store excess refrigerant not immediately required by the system evaporator. The refrigerant is able to flow as necessary within the internal containment volume and exits the subassembly 100 through the lower port 144*b*, ensuring a supply of liquid refrigerant to the evaporator. This liquid refrigerant then expands through an expansion valve (not shown) and is superheated in the system evaporator (not shown) by the medium to be cooled. Refrigerant exiting the evaporator returns to the suction header 274 to repeat the cycle.

The locations of the individual refrigeration components and piping as illustrated is merely exemplary, and any or all of the components could be positioned on other platforms 170 as dictated by spacing needs or other configuration parameters. Additional components of a refrigeration circuit may also be added to the assembly 200, such as sub-coolers, filters, or driers, etc. Furthermore, the piping arrangements are located only to facilitate assembly and interconnection of the refrigeration components and are not limited to those illustrated. In some embodiments, for example, the subassembly 100 could be utilized as a rooftop condenser supporting assembly. In yet other embodiments, the generally smaller diameters of the legs 110 and cross members 134 permit higher system pressures and the use of a $CO_2$-based refrigeration circuit. Any of the frame assemblies 100 of FIGS. 2-14 can be used as a part of a refrigeration assembly 200 in the manner previously described.

In addition, in other embodiments the supporting members or legs 110 need not be vertically oriented and/or the cross members 134 need not be horizontally oriented. The cross members 134, for example, could be at any angle with respect to the legs 110. In general, a plurality of hollow support members secured to and in fluid communication with each other could be angled at other than a vertical or horizontal orientation with respect to a support surface, e.g., a support surface 120, while providing sufficient structure for a support platform, such as a platform 170, configured to support or bear the operational forces of one or more components of a refrigeration assembly 200. Moreover, the legs 110 and cross members 134 can be of any geometric cross-sectional shape.

The frame subassembly 100 permits a more efficient combination of refrigeration system components. Elimination of an ASME certified receiving tank and associated instruments and/or valves results in a smaller operating footprint, reduced overall weight, and lower assembly and construction costs. The additional mass of refrigerant in the system due to the increased capacity of the receiver also reduces vibrations generated by the compressors.

Various features and advantages of the invention are set forth in the following claims.

The invention claimed is:

1. A subassembly of a refrigeration system, the subassembly comprising:

a frame including a plurality of support members, and one or more cross members, each cross member extending between two of the support members;

a heat exchanger configured to condense refrigerant; and a compressor supported by a portion of the frame and operable to provide refrigerant to the heat exchanger, wherein the portion of the frame supporting the compressor defines a receiver configured to receive and contain refrigerant condensed by the heat exchanger.

2. The subassembly of claim 1, wherein the support members are each in the form of hollow tubes, and wherein at least one of the support members is configured to receive and contain refrigerant condensed by the heat exchanger.

3. The subassembly of claim 1, wherein the one or more cross members are each in the form of hollow tubes, and wherein at least one of the one or more cross members is configured to receive and contain refrigerant condensed by the heat exchanger.

4. The subassembly of claim 1, wherein each cross member and each support member communicate to form a containment volume suitable to receive and contain refrigerant condensed by the heat exchanger.

5. The subassembly of claim 1, wherein the frame includes an inlet port for receiving refrigerant condensed by the heat exchanger.

6. The subassembly of claim 1, wherein the frame includes an outlet port for discharging refrigerant condensed by the heat exchanger.

7. The subassembly of claim 1, further including a mounting surface supported by at least one of the one or more cross members.

8. The subassembly of claim 7, wherein the heat exchanger is supported by the mounting surface.

9. A frame subassembly for a refrigeration assembly, the frame subassembly comprising:

a frame; and a mounting surface coupled to the frame and configured to support a compressor and a heat exchanger of the refrigeration assembly, wherein the mounting surface is supported by a portion of the frame that defines a receiver configured to receive and contain refrigerant condensed by the heat exchanger.

10. The frame subassembly of claim 9, wherein the frame includes at least one vertically oriented member configured to receive refrigerant condensed by the heat exchanger.

11. The frame subassembly of claim 10, wherein the at least one vertically oriented member is in the form of a hollow tube.

12. The frame subassembly of claim 10, wherein the at least one vertically oriented member is configured to contain refrigerant condensed by the heat exchanger.

13. The frame subassembly of claim 9, wherein the frame includes at least one horizontally oriented member configured to receive refrigerant condensed by the heat exchanger.

14. The frame subassembly of claim 13, wherein the frame includes at least one vertically oriented member configured to receive refrigerant condensed by the heat exchanger and wherein the at least one horizontally oriented member is in fluid communication with the at least one vertically oriented member.

15. A refrigeration system, the system comprising:

a compressor configured to provide a flow of refrigerant to a heat exchanger; and a receiver configured to store refrigerant condensed by the heat exchanger, wherein the compressor and the heat exchanger are both supported at least in part by the receiver.

16. A method for operating a refrigeration circuit, the method comprising:

operating a compressor of the refrigeration circuit to compress a refrigerant;

discharging the compressed refrigerant to a heat exchanger;

condensing at least a portion of the compressed refrigerant within the heat exchanger;

receiving the condensed refrigerant from the heat exchanger within a structure defining a receiver and configured to at least partially support both the compressor and the heat exchanger.

17. The method of claim 16, wherein receiving the condensed refrigerant within the structure includes receiving the condensed refrigerant within a vertically oriented hollow tube.

18. The method of claim 17, wherein receiving the condensed refrigerant within the structure includes receiving the condensed refrigerant within a horizontally oriented hollow tube in fluid communication with the vertically oriented hollow tube.

* * * * *